US009116497B2

(12) United States Patent
Miyazaki

(10) Patent No.: US 9,116,497 B2
(45) Date of Patent: Aug. 25, 2015

(54) IMAGE FORMING APPARATUS AND CONTROL METHOD

(71) Applicant: KYOCERA Document Solutions Inc., Osaka (JP)

(72) Inventor: Tadashi Miyazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/470,169

(22) Filed: Aug. 27, 2014

(65) Prior Publication Data

US 2015/0063845 A1 Mar. 5, 2015

(30) Foreign Application Priority Data

Aug. 30, 2013 (JP) ..... 2013-180521

(51) Int. Cl.
*G03G 15/00* (2006.01)
*G03G 15/20* (2006.01)

(52) U.S. Cl.
CPC ..... *G03G 15/80* (2013.01); *G03G 15/205* (2013.01); *G03G 15/5004* (2013.01); *G03G 15/55* (2013.01)

(58) Field of Classification Search
USPC ..... 399/9, 37, 38, 67–70, 88; 713/300, 320
See application file for complete search history.

(56) References Cited

U.S. PATENT DOCUMENTS 7,412,185 B2 * 8/2008 Hall et al. ..... 399/88
7,949,885 B2 * 5/2011 Kikuchi et al. ..... 713/300
2005/0191087 A1 * 9/2005 Nishimura ..... 399/111

FOREIGN PATENT DOCUMENTS

JP 2010-020150 A 1/2010

* cited by examiner

*Primary Examiner* — Hoan Tran
(74) *Attorney, Agent, or Firm* — Studebaker & Brackett PC

(57) ABSTRACT

An image forming apparatus includes a fixing section, a low voltage detection circuit, an arithmetic control section, and a storage section. The fixing section has a heater and fixes a toner image on recording paper with heat of the heater. The low voltage detection circuit detects a drop in an input voltage from a power source. The arithmetic control section determines, when a drop in the input voltage is detected by the low voltage detection circuit, whether the drop in the input voltage is linked to working of the heater. The arithmetic control section lowers the temperature of the heater when the drop in the input voltage is linked to the working of the heater, and causes the storage section to store a result of the detection by the low voltage detection circuit when the drop in the input voltage is not linked to the working of the heater.

10 Claims, 4 Drawing Sheets

IMAGE FORMING APPARATUS AND CONTROL METHOD

INCORPORATION BY REFERENCE

The present application claims priority under 35 U.S.C. §119 to Japanese Patent Application No. 2013-180521, filed Aug. 30, 2013. The contents of this application are incorporated herein by reference in their entirety.

BACKGROUND

The present disclosure relates to image forming apparatuses and control methods.

A certain image forming apparatus determines whether or not its power source has a failure when there is a drop in the supply voltage. The image forming apparatus executes warning display in the case of a failure.

The image forming apparatus includes a supply voltage measuring means, a unit-by-unit supply voltage drop measuring means, a table, a display means, and a control means.

The supply voltage measuring means measures the supply voltage. The unit-by-unit supply voltage drop measuring means causes the supply voltage measuring means to measure amounts of drop in the supply voltage when a plurality of units are energized independently on a unit-by-unit basis. The table stores the amounts of drop in the supply voltage for the respective units measured by order of the unit-by-unit supply voltage drop measuring means. The display means displays information related to the image forming apparatus.

The control means controls the image forming apparatus. The control means determines a threshold value of the drop in the supply voltage based on the total of the amounts of drop in the supply voltage for units in energization out of the amounts of drop in the supply voltage for the respective units stored in the table. If an amount of drop in the supply voltage measured by the supply voltage measuring means is larger than the threshold value, the control means determines it as a power source failure and causes the display means to execute warning display.

SUMMARY

According to a first aspect of the present disclosure, an image forming apparatus includes a fixing section, a low voltage detection circuit, an arithmetic control section, and a storage section. The fixing section has a heater and fixes a toner image on recording paper with heat of the heater. The low voltage detection circuit detects a drop in an input voltage from a power source. The arithmetic control section determines, when the drop in the input voltage is detected by the low voltage detection circuit, whether or not the drop in the input voltage is linked to working of the heater. The arithmetic control section lowers the temperature of the heater when the drop in the input voltage is linked to the working of the heater, and causes the storage section to store a result of the detection by the low voltage detection circuit when the drop in the input voltage is not linked to the working of the heater.

According to a second aspect of the present disclosure, there is provided a control method for controlling an image forming apparatus that fixes a toner image on recording paper with heat of a heater. The control method includes: determining whether or not there is a drop in an input voltage from a power source based on a detection signal from a low voltage detection circuit; determining whether or not the drop in the input voltage is linked to working of the heater; lowering the temperature of the heater when the drop in the input voltage is linked to the working of the heater; and causing a storage section to store a result of the detection by the low voltage detection circuit when the drop in the input voltage is not linked to the working of the heater.

DETAILED DESCRIPTION

Hereinafter, an embodiment of the present disclosure will be described with reference to the accompanying drawings.

Figure 1:
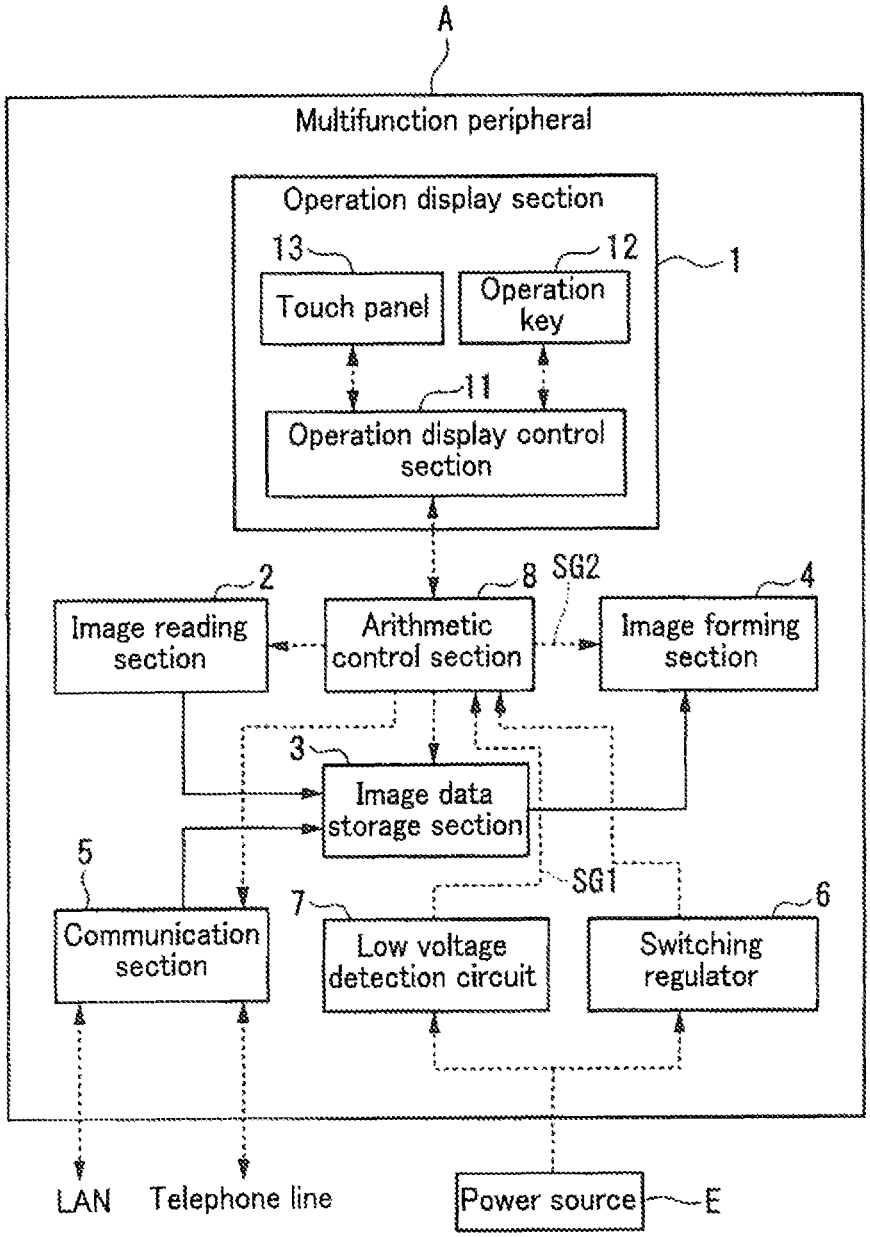
FIG. 1 is a functional block diagram of a multifunction peripheral according to an embodiment of the present disclosure.

A multifunction peripheral A according to the present embodiment will be described with reference to FIG. 1. FIG. 1 is a functional block diagram of the multifunction peripheral A. The multifunction peripheral A is an image forming apparatus that forms an image on recording paper by an electrographic process. The multifunction peripheral A includes an operation display section 1, an image reading section 2, an image data storage section 3, an image forming section 4, a communication section 5, a switching regulator 6, a low voltage detection circuit 7, and an arithmetic control section 8. In FIG. 1, the solid arrows represent flows of data, whereas the dotted arrows represent flows of control signals (such as a control signal SG2) or detection signals (such as a detection signal SG1).

The operation display section 1 includes an operation display control section 11, operation keys 12 being hardware keys, and a touch panel 12 (display section). The touch panel 13 displays software keys and various images. The operation display section 1 functions as a man-machine interface associating users with the multifunction peripheral A.

The operation display control section 11 is a controller that controls the operation keys 12 and the touch panel 13 under the control of the arithmetic control section 8. The operation display control section 11 includes an arithmetic processor, an internal memory, an interface circuit, and so on. The interface circuit executes transmission and receipt of signals to and from the operation keys 12 and the touch panel 13 electrically interconnected with the interface circuit. The operation display control section 11 controls overall operation of the operation display section 1 based on an operation display control program stored in the internal memory.

For example, the operation display control section 11 causes the touch panel 13 to display operation buttons and the various images by outputting display signals to the touch panel 13. In addition, the operation display control section 11 determines which of the operation keys 12 has been operated or which of the operation buttons displayed on the touch panel 13 has been operated according to operation signals input through the operation keys 12 or the touch panel 13. Based on the result of the determination, the operation display control section 11 outputs operation result signals to the arithmetic control section 8.

The operation keys 12 are physically provided to the operation display section 1 as hardware keys. The operation keys 12 may be a power key, a start key, a stop/clear key, and a numeric keypad (numerical value entry keys), for example. When a user presses any of the operation keys 12, the operation key 12 outputs an operation signal to the operation display control section 11.

The touch panel 13 is formed from a transparent sheet pressure sensor of a resistive type or the like provided on a display surface of a display panel as is well known. The touch panel 13 displays the operation buttons on the display panel according to the display signal input from the operation display control section 11. When any of the operation buttons displayed on the touch panel 13 is pressed by a finger or the like of a user, the sheet pressure sensor outputs an operation signal representing a press position (press coordinates) to the operation display control section 11.

Figure 2:
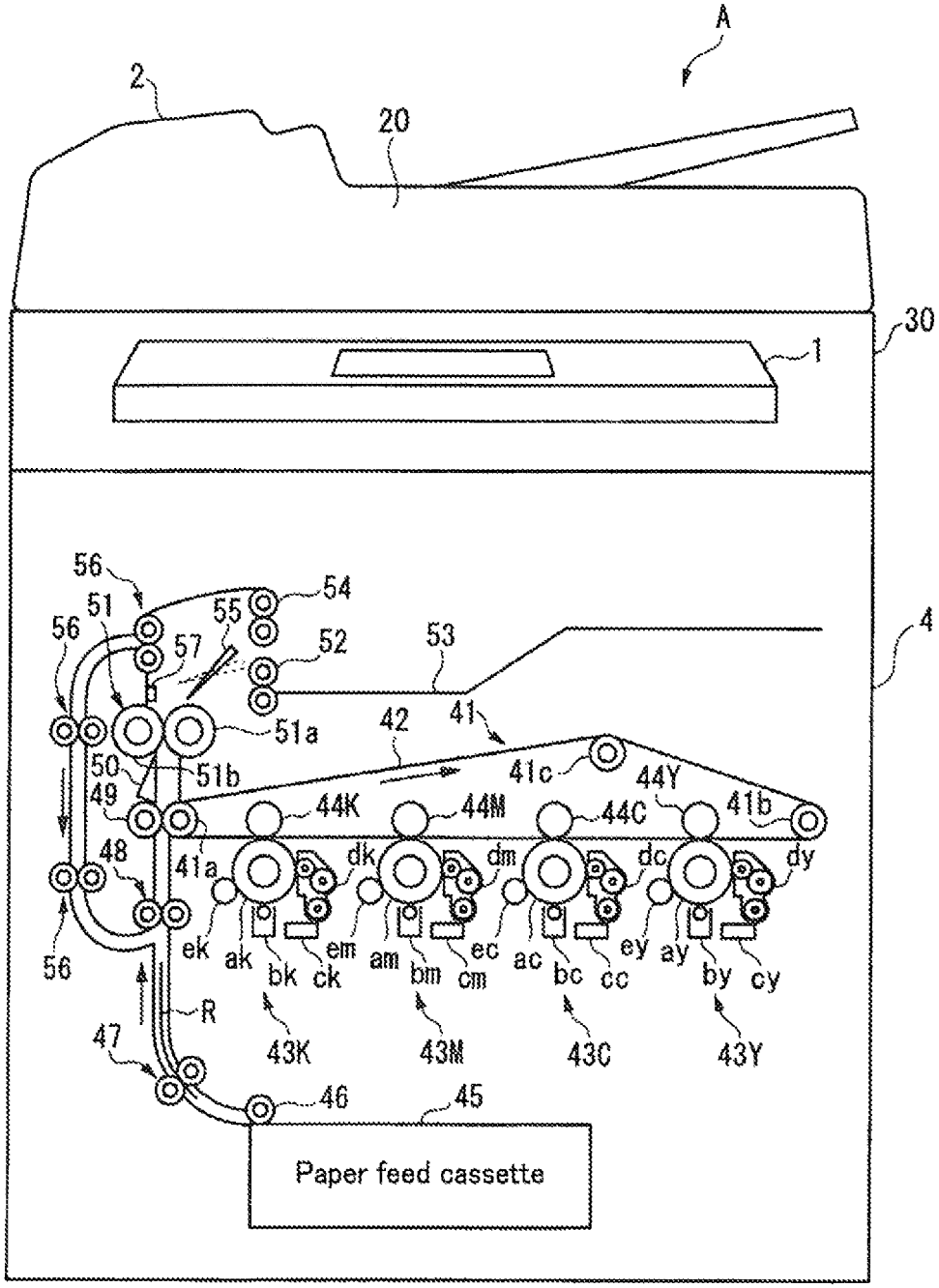
FIG. 2 is a schematic cross sectional view of a multifunction peripheral according to an embodiment of the present disclosure.

Other components will be described with reference to FIGS. 1 to 4. FIG. 2 is a schematic cross sectional view of the multifunction peripheral A. The image reading section 2 includes an automatic document feeder (ADF) 20 and a flatbed reading section 30. The image reading section 2 reads an image (original document image) on a surface of an original document fed from the ADF 20 or an original document placed on the flatbed reading section 30 by a user according to control signals input from the arithmetic control section 8 and converts the image read into original document image data. The image reading section 2 then outputs the original document image data to the image data storage section 3 according to control signals input from the arithmetic control section 8.

The image data storage section 3 is a semiconductor memory, a hard disk drive, or the like. The image data storage section 3 stores the original document image data, print image data transmitted from an external client computer and received by the communication section 5, or facsimile image data transmitted from an external facsimile machine and received by the communication section 5 according to control signals input from the arithmetic control section 8. The image data storage section 3 retrieves the original document image data, the print image data, or the facsimile image data and outputs it to the image forming section 4 according to control signals input from the arithmetic control section 8.

The image forming section 4 takes out recording paper R from a paper feed cassette 45 and forms, on the recording paper R, a toner image based on the image data retrieved from the image data storage section 3 according to control signals input from the arithmetic control section 8.

The image forming section 4 includes belt rollers 41, an intermediate transfer belt 42, four image forming units 43Y, 43C, 43M, and 43K corresponding to four colors of toners (Y, M, C, and K), a primary transfer rollers 44Y, 44C, 44M, and 44K, the paper feed cassette 45, a pickup roller 46, a pair of conveyance rollers 47, a pair of registration rollers 48, a secondary transfer roller 49, a separation static eliminator 50, a fixing section 51, a pair of paper discharge rollers 52, an exit tray 53, a pair of reversing rollers 54, a diverging guide 55, three pairs of reversed paper conveyance rollers 56, and a recording paper sensor 57.

The belt rollers 41 include three rollers disposed at intervals, that is, a drive roller 41*a*, a driven roller 41*b*, and a tension roller 41*c*. Specifically, the drive roller 41*a* and the driven roller 41*b* are disposed with a specified distance therebetween in the horizontal direction. The tension roller 41*c* is disposed in a position slightly upper than a position between the drive roller 41*a* and the driven roller 41*b*. The intermediate transfer belt 42 is an endless belt wound around the belt rollers 41 (the drive roller 41*a*, the driven roller 41*b*, and the tension roller 41*c*). The intermediate transfer belt 42 travels (rotates) in the arrowed direction under driving of the drive roller 41*a*.

The intermediate transfer belt 42 travels in the horizontal direction between the drive roller 41*a* and the driven roller 41*b*. The drive roller 41*a* is a roller connected to a motor that generates a driving force. The drive roller 41*a* rotates under the driving force from the motor and causes the intermediate transfer belt 42 to travel in the arrowed direction. The driven roller 41*b* is a free roller provided so as to freely rotate. The driven roller 41*b* is driven by the rotation of the intermediate transfer belt 42 to rotate. The tension roller 41*c* is a roller provided such that its rotational axis is movable. The tension roller 41*c* gives a constant level of tension to the intermediate transfer belt 42 by pressing the intermediate transfer belt 42 at a specified pressing force.

The image forming units 43Y, 43C, 43M, and 43K are disposed at predetermined intervals on a horizontally-travelling part of the intermediate transfer belt 42. The image forming unit 43Y forms a yellow (Y) toner image and is disposed in a position closest to the driven roller 41*b*. The image forming unit 43C forms a cyan (C) toner image and is disposed in a position next closest to the driven roller 41*b* after the image forming unit 43Y. The image forming unit 43M forms a magenta (M) toner image and is disposed in a position next closest to the driven roller 41*b* after the image forming unit 43C. The image forming unit 43Y forms a black (K) toner image and is disposed in a position closest to the drive roller 41*a*.

The image forming unit 43Y includes a photosensitive drum "ay", a charger "by", a laser scanning unit "cy", a developing unit "dy", and a cleaner "ey". The image forming unit 43C includes a photosensitive drum "ac", a charger "bc", a laser scanning unit "cc", a developing unit "dc", and a cleaner "ec". The image forming unit 43M includes a photosensitive drum "am", a charger "bm", a laser scanning unit "cm", a developing unit "dm", and a cleaner "em". The image forming unit 43K includes a photosensitive drum "ak", a charger "bk", a laser scanning unit "ck", a developing unit "dk", and a cleaner "ek".

Each of the photosensitive drums "ay", "ac", "am", and "ak" is a cylindrical member having a peripheral surface formed from a photosensitive material (e.g., amorphous silicon). The chargers "by", "bc", "bm", and "bk" uniformly charge the peripheral surfaces (photosensitive surfaces) of the photosensitive drums "ay", "ac", "am", and "ak", respectively. Each of the laser scanning units "cy", "cc", "cm", and "ck" irradiates the corresponding charged photosensitive surface with laser light to form an electrostatic latent image on the photosensitive surface.

Each of the developing units "dy", "dc", "dm", and "dk" contains a predetermined amount of toner (positive polarity toner). Each of the developing units "dy", "dc", "dm", and "dk" develops the electrostatic latent image formed on the corresponding photosensitive surface by supplying the toner to the photosensitive surface to form a toner image on the photosensitive surface. Each of the cleaners "ey", "ec", "em", and "ek" scrapes off and removes the toner remaining on the corresponding photosensitive surface (residual toner) after transfer of the toner image.

The four primary transfer rollers 44Y, 44C, 44M, and 44K are provided corresponding to the four image forming units 43Y, 43C, 43M, and 43K. The primary transfer rollers 44Y, 44C, 44M, and 44K are disposed to face the photosensitive drums "ay", "ac", "am", and "ak" of the image forming unit 43Y, 43C, 43M, and 43K, respectively, via the intermediate transfer belt 42. A negative polarity primary transfer bias (high voltage) is applied to each of the primary transfer rollers 44Y, 44C, 44M, and 44K. The primary transfer rollers 44Y, 44C, 44M, and 44K transfer (primarily transfer) the toner images formed on the photosensitive drums "ay", "ac", "am", and "ak" of the image forming units 43Y, 43C, 43M, and 43K, respectively, to the intermediate transfer belt 42 by the effect of the primary transfer bias.

The paper feed cassette 45 is a container that accommodates a plurality of sheets of recording paper R with a standard size such as A4 or B5 and in a stacked state. The pickup roller 46 is provided to be in pressed contact with the recording paper R at an upper part of the paper feed cassette 45. The pickup roller 46 picks up the recording paper R in the paper feed cassette 45 sheet by sheet and sends it out to the pair of conveyance rollers 47. The pair of conveyance rollers 47 conveys the recording paper R fed by the pickup roller 46 toward the pair of registration rollers 48. The pair of registration rollers 48 feeds the recording paper R fed by the pair of conveyance rollers 47 to the second transfer roller 49 with predetermined timing.

The secondary transfer roller 49 is disposed so as to face the drive roller 41*a* via the intermediate transfer belt 42. The secondary transfer roller 49 transfers (secondarily transfers) the toner images on the intermediate transfer belt 42 to the recording paper R. A negative polarity secondary transfer bias (high voltage) is applied to the secondary transfer roller 49. The secondary transfer roller 49 transfers (secondarily transfers) the toner images on the intermediate transfer belt 42 to the recording paper R by the effect of the secondary transfer bias.

The separation static eliminator 50 applies a positive polarity charge eliminating bias to the recording paper R according to control signals input from the arithmetic control section 8. The recording paper R is electrically neutralized by the charge eliminating bias to be in a non-charged state. As a result, the recording paper R is readily separated from the secondary transfer roller 49. The separation static eliminator 50 has a stainless sawtooth electrode and eliminates charges on the recording paper R by forming an electric field around an edge of the sawtooth electrode.

Figure 3:
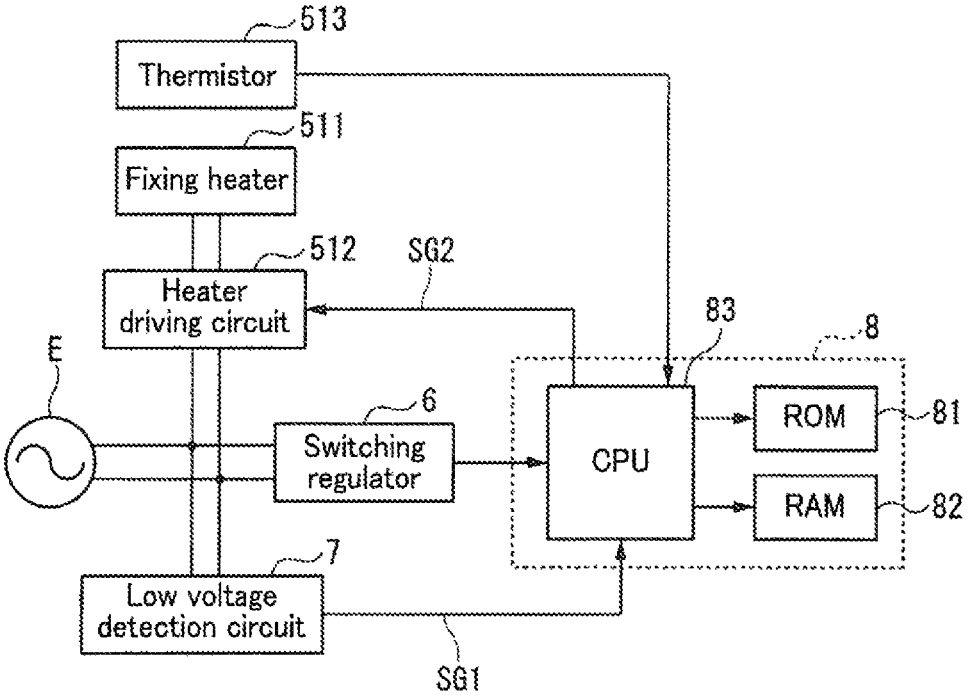
FIG. 3 is a diagram showing the connection relationship among a switching regulator, a low voltage detection circuit, an arithmetic control section, a fixing heater, a heater driving circuit, and a thermistor according to an embodiment of the present disclosure.

The fixing section 51 will be described with reference to FIGS. 2 and 3. FIG. 3 is a diagram showing the connection relationship among the fixing section 51 (a fixing heater 511, a heater driving circuit 512, and a thermistor 513), the switching regulator 6, the low voltage detection circuit 7, and the arithmetic control section 8.

The fixing section 51 includes the fixing heater 511 (heater) and fixes the toner images on the recording paper R with the heat of the fixing heater 511. Specifically, the fixing section 51 includes a heating roller 51*a* in which the fixing heater 511 is provided and a pressure roller 51*b* in pressed contact with the heating roller 51*a*. The fixing section 51 heats and pressurizes the recording paper R by nipping, between the heating roller 51*a* and the pressure roller 51*b*, the recording paper R having the respective colors of toner images transferred thereto to fix the respective colors of toner images on the recording paper R. Each of the heating roller 51*a* and the pressure roller 51*b* has a contact surface (surface) to be in contact with the recording paper R. The contact surfaces are formed from a fluorinated material that is negatively charged by friction. Accordingly, the surfaces of the heating roller 51*a* and the pressure roller 51*b* are negatively charged by the friction with the recording paper R.

The fixing section 51 further includes the heater driving circuit 512 that drives the fixing heater 511 and the thermistor 513 that detects the temperature of the heating roller 51*a* (see FIG. 3).

The heater driving circuit 512 controls a voltage supplied from an external power source E (e.g., commercial power source) to maintain it at an appropriate level and supplies the voltage to the fixing heater 511 under the control of the arithmetic control section 8, that is, according to the control signal SG2 from the arithmetic control section 8.

The thermistor 513 detects the temperature of the heating roller 51*a* and outputs a temperature detection signal representing the detection result to the arithmetic control section 8. Based on the temperature of the heating roller 51*a* represented by the temperature detection signal input from the thermistor 513, the arithmetic control section 8 controls the heater driving circuit 512 so that the heating roller 51*a* is heated up to a target temperature. So far, the fixing section 51 has been described.

As shown in FIG. 2, the pair of paper discharge rollers 52 discharges, toward the exit tray 53, the recording paper R conveyed from the fixing section 51 and guided by the diverging guide 55. The exit tray 53 contains and holds the recording paper R discharged by the paper discharge rollers 52. The pair of reversing rollers 54 conveys, forward or backward in a switching manner, the recording paper R conveyed from the fixing section 51 and guided by the diverging guide 55. That is, the pair of reversing rollers 54 rotates in a normal direction to nip therebetween the recording paper R fed from the fixing section 51 and further rotates in a counter direction while keeping the recording paper R therebetween to convey the recording paper R toward the pairs of reversed paper conveyance rollers 56.

The diverging guide 55 alternatively switches the conveyance destination of the recording paper R fed from the fixing section 51 between the pair of paper discharge rollers 52 and the pair of reversing rollers 54 based on control signals input from the arithmetic control section 8. That is, the diverging guide 55 takes a first posture (posture represented by the dotted line in FIG. 2) thereby to switch the conveyance destination of the recording paper R to the pair of paper discharge rollers 52 when the recording paper R is to be discharged onto the exit tray 53. On the contrary, the diverging guide 55 takes a second posture (posture represented by the solid line in FIG. 2) thereby to switch the conveyance destination of the recording paper R to the pair of reversing rollers 54.

The pairs of reversed paper conveyance rollers 56 are provided in a conveyance path (reverse path) through which the recording paper R fed by the pair of reversing rollers 54 is conveyed toward the pair of registration rollers 48. The pairs of reversed paper conveyance rollers 56 are provided in three positions in the reverse path at intervals. The recording paper sensor 57 is disposed between the fixing section 51 and the diverging guide 55. The recording paper sensor 57 detects the number of sheets of the recording paper R passing through the fixing section 51 and outputs a detection signal representing the number of sheets to the arithmetic control section 8.

In the image forming section 4, double-sided image forming processing for forming toner images on a front side and a back side of the recording paper R is performed by the pair of reversing rollers 54, the diverging guide 55, and the pairs of reversed paper conveyance rollers 56. That is, the recording paper R with an image formed on the front side thereof passes through the fixing section 51, is reversed, and then is re-fed to the pair of registration rollers 48, so that an image is formed on the back side.

As shown in FIG. 1, the communication section 5 communicates with an external multifunction peripheral or an external facsimile machine via a telephone line, or with a client computer or the like via a local area network (LAN) according to control signals input from the arithmetic control section 8. That is, the communication section 5 has both a communicating function in conformity with a LAN standard such as Ethernet (registered trademark) and a communicating function in conformity with a facsimile standard such as G3.

The switching regulator 6 is a voltage down converter that converts an alternating-current voltage supplied from the external power source E into a direct-current voltage and reduces the direct-current voltage to supply it to the arithmetic control section 8.

Figure 4:
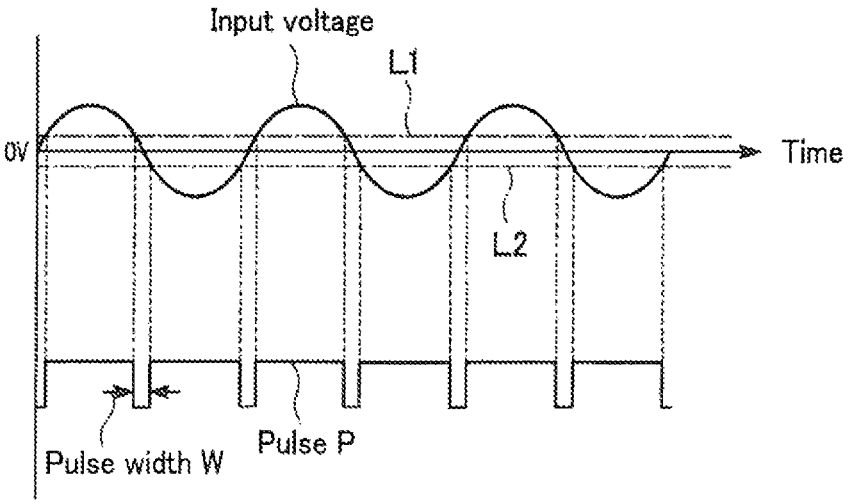
FIG. 4 is a diagram showing a mechanism of detection of a drop in an input voltage from a power source by the low voltage detection circuit according to an embodiment of the present disclosure.

The low voltage detection circuit 7 detects a drop in the input voltage from the external power source E and outputs the detection signal SG1 representing the detection result to the arithmetic control section 8. FIG. 4 is a diagram showing a mechanism of the detection of a drop in the input voltage from the power source E to be performed by the low voltage detection circuit 7. For example, the low voltage detection circuit 7 measures a length of time needed for the input voltage from the power source E to shift from a first value L1 to a second value L2, or vice versa, and detects a drop in the input voltage based on the length of time. The first value L1 and the second value L2 are set so as to bracket a voltage of 0 V. The mechanism will be described later in detail with reference to the operation of the multifunction peripheral A.

As shown in FIG. 3, the arithmetic control section 8 includes a read only memory (ROM) 81 (storage section), a random access memory (RAM) 82, and a central processing unit (CPU) 83. The arithmetic control section 8 communicates with the other sections and controls overall operation of the multifunction peripheral A based on arithmetic control programs stored in the ROM 81.

The ROM 81 is a non-volatile memory storing the various arithmetic control programs to be executed by the CPU 83 and other data.

The RAM 82 is a volatile memory to be used as a working area serving as a destination to temporarily save data when the CPU 83 executes the various arithmetic control programs and performs various types of operation.

The CPU 83 has an interface. The interface executes transmission and reception of various signals from and to the other sections electrically interconnected to the interface. The CPU 83 controls overall operation of the multifunction peripheral A by performing various types of arithmetic processing and communicating with the other sections based on the various arithmetic control programs stored in the ROM 81. The arithmetic control section 8 detects a drop in the input voltage from the power source E based on the detection signal SG1 input from the low voltage detection circuit 7 and executes processing according to the drop in the input voltage as discussed in detail below.

Next, the operation of the multifunction peripheral A will be described in detail with reference to FIGS. 1 to 6.

First, the overall operation of the multifunction peripheral A will be described. As shown in FIGS. 1 and 2, for example, a user places original documents on the ADF 20 and gives an instruction to copy the original documents onto surfaces on one side of the recording paper R by operating the operation display section 1. In response, an instruction signal corresponding to the instruction by the user is input from the operation display section 1 into the arithmetic control section 8. As a result, the arithmetic control section 8 causes the image reading section 2 to read original document images sequentially on an original document page by original document page basis and causes the image data storage section 3 to store original document image data for each original document image. For each original document image, the arithmetic control section 8 then generates items of bitmap image data for the respective toner colors based on the original document image data and causes the image forming section 4 to execute image formation processing for the original document image based on the items of bitmap image data.

That is, the arithmetic control section 8 drives the pickup roller 46 to pick up the recording paper R in the paper feed cassette 45 sheet by sheet and send it out to the pair of conveyance rollers 47. At the same time, the arithmetic control section 8 drives the pair of conveyance rollers 47 to convey the recording paper R toward the pair of registration rollers 48. In addition, the arithmetic control section 8 drives the drive roller 41*a* to bring the intermediate transfer belt 42 into a traveling state. At the same time, the arithmetic control section 8 drives the image forming units 43Y, 43C, 43M, and 43K to form the toner images of the four colors of positive polarity toners on the photosensitive surfaces (peripheral surfaces) of the photosensitive drums "ay", "ac", "am", and "ak" based on the items of bitmap image data. The arithmetic control section 8 then applies the negative polarity primary transfer bias to the respective primary transfer rollers 44Y, 44C, 44M, and 44K, thereby primarily transferring the toner images on the photosensitive drums "ay", "ac", "am", and "ak" onto the intermediate transfer belt 42.

Thereafter, the arithmetic control section 8 drives the pair of registration rollers 48 in timed relation to the color-by-color image formation processing in the image forming units 43Y, 43C, 43M, and 43K, and applies the negative polarity secondary transfer bias to the secondary transfer roller 49, thereby secondarily transferring the toner images (original document images) on the intermediate transfer belt 42 to a desired position on the recording paper R. The arithmetic control section 8 then causes the separation static eliminator 50 to eliminate charges on the recording paper R with a positive polarity charge eliminating bias and drives the fixing section 51. At the same time, the arithmetic control section 8 switches the posture of the diverging guide 55 to the first posture (posture represented by the dotted line in FIG. 2), thereby conveying the recording paper R toward the pair of paper discharge rollers 52. The arithmetic control section 8 then drives the pair of paper discharge rollers 52 to discharge the recording paper R onto the exit tray 53.

In the case where the user gives an instruction to copy the original documents onto surfaces on both sides of the recording paper R, the arithmetic control section 8 proceeds with the processing in the same manner as in the one-sided copying of the original documents until the fixing section 51 is driven, and takes different processing thereafter. That is, the arithmetic control section 8 drives the fixing section 51 and switches the posture of the diverging guide 55 to the second posture (posture represented by the solid line in FIG. 2), thereby conveying the recording paper R toward the pair of reversing rollers 54. The arithmetic control section 8 then causes the pair of reversing rollers 54 to rotate in a normal direction for a predetermined period of time, and then switches the posture of the diverging guide 55 to the first posture. At the same time, the arithmetic control section 8 causes the pair of reversing rollers 54 to rotate in a counter direction, thereby conveying the recording paper R toward the pairs of reversed paper conveyance rollers 56. The arithmetic control section 8 then drives the pairs of reversed paper conveyance rollers 56, thereby conveying the recording paper R toward the pair of registration rollers 48.

In addition, the arithmetic control section 8 causes the image forming units 43Y, 43C, 43M, and 43K to form toner images of the four colors of positive polarity toners on the photosensitive surfaces of the photosensitive drums "ay", "ac", "am", and "ak". The arithmetic control section 8 then applies the negative polarity primary transfer bias to the respective primary transfer rollers 44Y, 44C, 44M, and 44K, thereby primarily transferring the toner images on the respective photosensitive drums "ay", "ac", "am", and "ak" onto the intermediate transfer belt 42.

Thereafter, the arithmetic control section 8 drives the pair of registration rollers 48 in timed relation to the color-by-color image formation processing in the image forming units 43Y, 43C, 43M, and 43K, and applies the negative polarity secondary transfer bias to the secondary transfer roller 49, thereby secondarily transferring the toner images on the intermediate transfer belt 42 to a desired position on the back side of the recording paper R. The arithmetic control section 8 then causes the separation static eliminator 50 to eliminate charges on the recording paper R with a positive polarity charge eliminating bias and drives the fixing section 51. At the same time, the arithmetic control section 8 switches the posture of the diverging guide 55 to the first posture, thereby conveying the recording paper R toward the pair of paper discharge rollers 52. The arithmetic control section 8 then drives the pair of paper discharge rollers 52 to discharge the recording paper R onto the exit tray 53.

If there is a drop in the input voltage from the power source E, the low voltage detection circuit 7 and the CPU 83 execute the following processing as shown in FIGS. 3 and 4. In the low voltage detection circuit 7, the first value L1 and the second value L2 are preset so as to bracket a voltage of 0 V. The low voltage detection circuit 7 generates a pulse P representing the length of time needed for the input voltage from the power source E to shift from the first value L1 to the second value L2, or vice versa. A pulse width W of the pulse P represents the length of time needed for the input voltage from the power source E to shift from the first value L1 to the second value L2, or vice versa.

The low voltage detection circuit 7 then determines whether or not the pulse width W of the pulse P, that is, the length of time is larger than a threshold value and, if larger, outputs to the CPU 83 the detection signal SG1 indicating that there is a drop in the input voltage from the power source E. This threshold processing utilizes the fact that when there is a drop in the input voltage from the power source E, the change in the input voltage is more gradual, and as a result the time needed for the input voltage to shift from the first value L1 to the second value L2, or vice versa, is longer.

Figure 5:
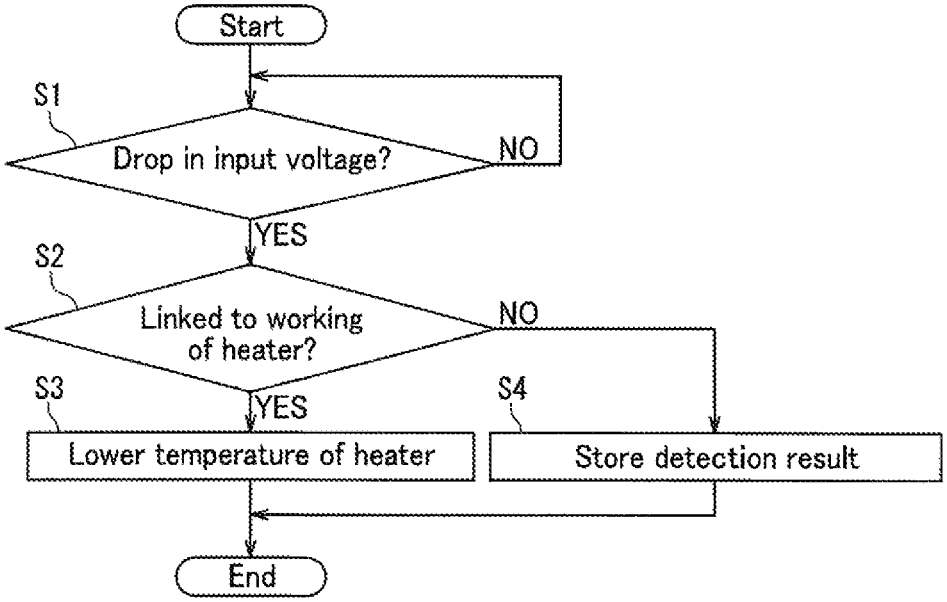
FIG. 5 is a flowchart showing processing by a CPU according to an embodiment of the present disclosure.

The processing by the CPU 83 in response to a drop in the input voltage will be described with reference to FIGS. 3 and 5. FIG. 5 is a flowchart showing the processing by the CPU 83, that is, a control method to be performed by the CPU 83. In Step S1, the CPU 83 determines whether or not there is a drop in the input voltage based on the detection signal SG1 from the low voltage detection circuit 7. When there is not a drop in the input voltage from the power source E (NO in Step S1), then the CPU 83 repeats the determination process in Step S1. When there is a drop in the input voltage from the power source E (YES in Step S1), then the CPU 83 causes the processing to proceed to Step S2. In Step S2, the CPU 83 determines whether or not the drop in the input voltage is linked to the working of the fixing heater 511.

Figure 6:
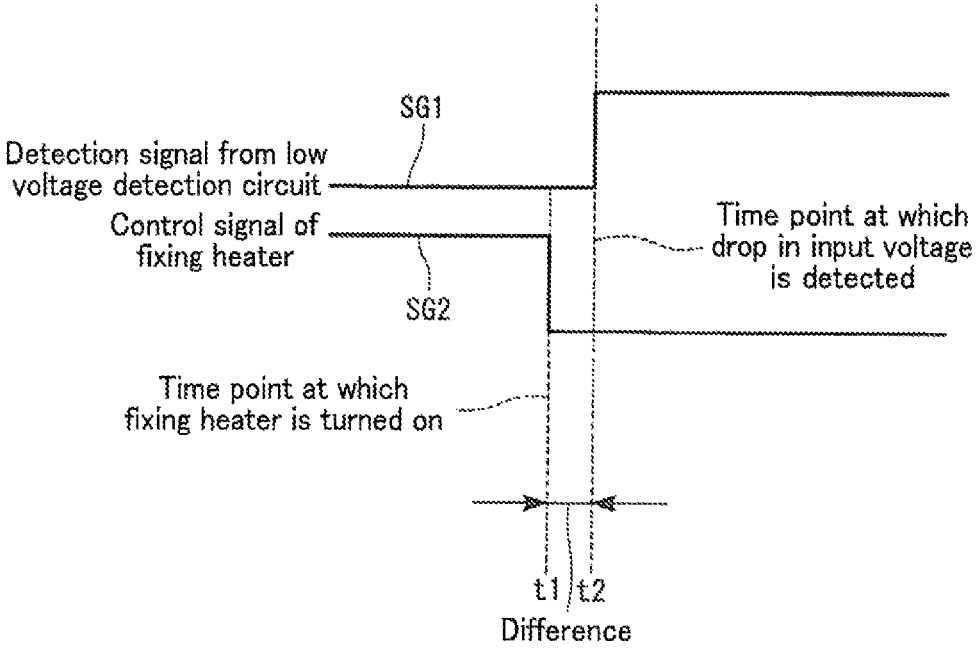
FIG. 6 is a diagram showing a mechanism of a determination process by a CPU according to an embodiment of the present disclosure.

Herein, the determination process in Step S2 will be described in detail with reference to FIG. 6. FIG. 6 is a diagram showing a mechanism of the determination process by the CPU 83. When the difference between a time point t1 at which the fixing heater 511 is turned on and a time point t2 at which a drop in the input voltage is detected is within a predetermined period of time, the CPU 83 determines that the drop in the input voltage is linked to the working of the fixing heater 511. When the difference is larger than the predetermined period of time, the CPU 83 determines that the drop in the input voltage is not linked to the working of the fixing heater 511. A time point at which the control signal SG2 changes to a low level is the time point t1 at which the fixing heater 511 is turned on. A time point at which the detection signal SG1 changes to a high level is the time point t2 at which the drop in the input voltage is detected.

Referring back to FIG. 5, when the drop in the input voltage is linked to the working of the fixing heater 511 (YES in Step S2), then the CPU 83 causes the processing to proceed to Step S3. In Step S3, in order to overcome the drop in the input voltage, the CPU 83 controls the heater driving circuit 512 to lower the temperature of the fixing heater 511 based on a temperature detection signal input from the thermistor 513.

For example, the CPU 83 controls the pair of conveyance rollers 47 and so on in the image forming section 4 so that the conveyance speed of the recording paper R is reduced (e.g., the conveyance speed is reduced to half) as well as lowers the temperature of the fixing heater 511. The reduction of the conveyance speed of the recording paper R increases the time needed for the recording paper R to pass through the fixing section 51. Accordingly, the image formation can be continued without causing image quality loss even if the temperature of the fixing heater 511 is lowered.

In the case of color printing, the temperature of the fixing heater 511 is set higher than that in the case of monochrome printing in order to prevent shine of toner. However, the temperature of the fixing heater 511 may be lowered in order to avoid a drop in the input voltage. The temperature of the fixing heater 511 is lowered because the power consumption by the fixing heater 511 accounts for most (60% to 80%) of the power consumption by the multifunction peripheral A.

When the drop in the input voltage is not linked to the working of the fixing heater 511 (NO in Step S2), then the CPU 83 causes the processing to proceed to Step S4. In Step S4, the CPU 83 causes the ROM 81 to store a result of the detection by the low voltage detection circuit 7 indicating the drop in the input voltage together with a time stamp. A drop in the input voltage may be followed by a power down state. When the drop in the input voltage is not linked to the working of the fixing heater 511, therefore, the CPU 83 may cause the ROM 81 to store information indicating the current operational state, that is, information of a job in execution, information of a job on standby, and the like. A storage section such as a ROM or a flash memory may be provided outside the arithmetic control section 8. In this case, the CPU 83 may cause the external storage section to store the result of the detection by the low voltage detection circuit 7, the information of a job in execution, and the information of a job on standby.

When the drop in the input voltage is due to a temporal failure in the power source E, the CPU 83 may cause the touch panel 13 to display a warning screen showing that there is a drop in the voltage of the power source E and that the image formation is resumed once the input voltage from the power source E is normal again. For example, the warning screen includes a message "Drop in supply voltage". An instruction manual or the like may provide how to respond to the warning screen so that a user can take some measures such as connecting the multifunction peripheral A to another power feeding source (power source) or connecting a device sharing a power feeding source with the multifunction peripheral A to another power feeding source.

Thereafter, a representative of the seller such as a serviceman summoned to fix a malfunction of the multifunction peripheral A can check and analyze the data stored in the ROM 81 thereby to swiftly identify the cause of the malfunction as the drop in the supply voltage.

As described above, according to the present embodiment, when a drop in the input voltage is detected by the low voltage detection circuit 7, the CPU 83 determines whether or not the drop in the input voltage is linked to the working of the fixing heater 511. When the drop in the input voltage is linked to the working of the fixing heater 511, the CPU 83 lowers the temperature of the fixing heater 511. When the drop in the input voltage is not linked to the working of the fixing heater 511, the CPU 83 causes the ROM 81 to store the result of the detection by the low voltage detection circuit 7. As a result, a representative of the seller such as a serviceman can check the data stored in the ROM 81 thereby to swiftly identify the cause of the malfunction as the drop in the supply voltage.

Generally, a representative of a seller such as a serviceman can correctly determine whether or not the cause of a malfunction in an image forming apparatus is a drop in the supply voltage only by checking the apparatus on site. However, even if the representative such as a serviceman checks the apparatus on site, it is difficult to identify the cause of the malfunction because the drop in the supply voltage is not caused again.

On the contrary, the multifunction peripheral A (image forming apparatus) of the present embodiment can allow a representative of the seller such as a serviceman to swiftly identify the cause of a malfunction as a drop in the supply voltage.

Although the embodiment of the present disclosure has been described so far, the present disclosure is not limited to the embodiment. For example, the following variations may be contemplated.

In the above-described embodiment, the low voltage detection circuit 7 detects a drop in the input voltage based on the length of time needed for the input voltage to shift from the first value L1 to the second value L2, or vice versa, the first value L1 and the second value L2 being set so as to bracket a voltage of 0 V. However, the present disclosure is not limited thereto.

For example, the low voltage detection circuit 7 may measure the length of time needed for the input voltage to shift from the first value L1 to the second value L2, or vice versa, generate the pulse P representing the length of time (see FIG. 4), and detect a drop in the input voltage based on the level of a signal obtained by smoothing the pulse P. The first value L1 and the second value L2 are set so as to bracket a voltage of 0 V.

Alternatively, the low voltage detection circuit 7 may smooth the input voltage from the power source E and detect a drop in the input voltage based on the level of the smoothed input voltage.

Alternatively, the low voltage detection circuit 7 may be the switching regulator 6 having a control integrated circuit (IC) therein. That is, the low voltage detection circuit 7 being the switching regulator 6 may detect a drop in the input voltage based on the input voltage detected by the control IC.

What is claimed is:

1. An image forming apparatus comprising:

a fixing section having a heater and being configured to fix a toner image on recording paper with heat of the heater;

a low voltage detection circuit configured to detect a drop in an input voltage from a power source;

an arithmetic control section configured to determine, when the drop in the input voltage is detected by the low voltage detection circuit, whether or not the drop in the input voltage is linked to working of the heater; and a storage section, wherein the arithmetic control section lowers the temperature of the heater when the drop in the input voltage is linked to the working of the heater, and causes the storage section to store a result of the detection by the low voltage detection circuit when the drop in the input voltage is not linked to the working of the heater.

2. An image forming apparatus according to claim 1, wherein the low voltage detection circuit measures a length of time needed for the input voltage to shift from a first value to a second value, or vice versa, and detects the drop in the input voltage based on the length of time, the first value and the second value being set so as to bracket a voltage of 0 V.

3. An image forming apparatus according to claim 1, wherein the low voltage detection circuit detects a length of time needed for the input voltage to shift from a first value to a second value, or vice versa, generates a pulse representing the length of time, and detects the drop in the input voltage based on the level of a signal obtained by smoothing the pulse, the first value and the second value being set so as to bracket a voltage of 0 V.

4. An image forming apparatus according to claim 1, wherein the low voltage detection circuit smoothes the input voltage to detect the drop in the input voltage based on the level of the smoothed input voltage.

5. An image forming apparatus according to claim 1, wherein the low voltage detection circuit is a switching regulator having a control IC and detects the drop in the input voltage based on the input voltage detected by the control IC.

6. An image forming apparatus according to claim 1, wherein the arithmetic control section determines that the drop in the input voltage is linked to the working of the heater when the difference between a time point at which the heater is turned on and a time point at which the drop in the input voltage is detected is within a predetermined period of time, and determines that the drop in the input voltage is not linked to the working of the heater when the difference is larger than the predetermined period of time.

7. An image forming apparatus according to claim 1, further comprising:

a pair of conveyance rollers configured to convey the recording paper, wherein the arithmetic control section controls the pair of conveyance rollers so that a conveyance speed of the recording paper is reduced as well as lowers the temperature of the heater.

8. An image forming apparatus according to claim 1, wherein the arithmetic control section causes the storage section to store information of a job in execution when the drop in the input voltage is not linked to the working of the heater.

9. An image forming apparatus according to claim 1, further comprising:

a display section, wherein when the drop in the input voltage is due to a temporal failure in the power source, the arithmetic control section causes the display section to display a warning screen showing that there is a drop in the input voltage from the power source and that image formation is resumed once the input voltage is normal again.

10. A method for controlling an image forming apparatus that fixes a toner image on recording paper with heat of a heater, comprising:

determining whether or not there is a drop in an input voltage from a power source based on a detection signal from a low voltage detection circuit;

determining whether or not the drop in the input voltage is linked to working of the heater;

lowering the temperature of the heater when the drop in the input voltage is linked to the working of the heater; and causing a storage section to store a result of the detection by the low voltage detection circuit when the drop in the input voltage is not linked to the working of the heater.

* * * * *